United States Patent [19]

Yabuhara et al.

[11] 4,408,584

[45] Oct. 11, 1983

[54] AIR-FUEL RATIO CONTROL SYSTEM

[75] Inventors: Hideo Yabuhara, Musashino; Ichiro Kudo, Tokyo, both of Japan

[73] Assignees: Fuji Jukogyo Kabushiki Kaisha, Tokyo; Nissan Motor Co., Ltd., Yokohama, both of Japan

[21] Appl. No.: 282,984

[22] Filed: Jul. 14, 1981

[30] Foreign Application Priority Data

Jul. 16, 1980 [JP] Japan ..... 55-97358

[51] Int. Cl.[3] ..... F02B 3/00; F02M 7/00

[52] U.S. Cl. ..... 123/440; 123/489; 123/479

[58] Field of Search ..... 123/440, 489, 479

[56] References Cited

U.S. PATENT DOCUMENTS

| | | | |
|---|---|---|---|
| 4,155,335 | 5/1979 | Hosaka | 123/440 |
| 4,165,719 | 8/1979 | Asano | 123/440 |
| 4,208,993 | 6/1980 | Peter | 123/440 |

*Primary Examiner*—Ronald B. Cox

*Attorney, Agent, or Firm*—Martin A. Farber

[57] ABSTRACT

An air-fuel ratio control system for an internal combustion engine having an $O_2$-sensor for detecting the concentration of oxygen of exhaust gases passing through the exhaust passage, an electromagnetic valve for correcting the air-fuel ratio of the air-fuel mixture supplied by a carburetor, a feedback control circuit comprising a judging circuit for judging an output signal of the $O_2$-sensor and a driving circuit for driving the electromagnetic valve in dependency on an output signal of the judging circuit for controlling the air-fuel ratio to a value approximately to the stoichiometric air-fuel ratio. A Maximum and minimum value hold circuits respectively hold a maximum and a minimum value in one cycle of output variation of the detector. A first comparator compares the outputs of both hold circuits. A second comparator compares the output of the $O_2$-sensor with a predetermined level. A gate circuit is responsive to the output signals of the comparators for producing gate control signals. Switch circuits connect the $O_2$-sensor to the judging circuit. The gate circuit and the switch circuits operate such that when the output of the second comparator is high representing an output of the $O_2$-sensor is higher than the predetermined level, or when the output of the second comparator is low and the output of the first comparator means is high, the output of the $O_2$-sensor is connected to the judging circuit for performing the feedback control irrespective of the level of the detected air-fuel ratio, but when the outputs of both comparators are low, the fixed voltage supply source is connected to the judging circuit.

5 Claims, 8 Drawing Figures

| | | B | C | D | E | F |
|---|---|---|---|---|---|---|
| $A \geqq V_G$ | $V_H - V_L \geqq V_O$ | H | H | L | L | H |
| | $V_H - V_L < V_O$ | H | L | H | H | H |
| $A < V_G$ | $V_H - V_L \geqq V_O$ | L | H | L | L | H |
| | $V_H - V_L < V_O$ | L | L | H | L | L |

AIR-FUEL RATIO CONTROL SYSTEM

BACKGROUND OF THE INVENTION

The present invention relates to an air-fuel ratio control system for an internal combustion engine emission control system with a three-way catalytic converter, and more particularly to a system for a vehicle for controlling the air-fuel ratio to the stoichiometric air-fuel ratio so as to effectively operate the three-way catalyst.

The control system comprises a feedback control system, in which an $O_2$-sensor is provided on the exhaust passage of the internal combustion engine. The $O_2$-sensor is adapted to sense the oxygen content of exhaust gases to generate an electrical output dependent on the oxygen content as a representation of the air-fuel ratio of the air-fuel mixture which is supplied to the engine cylinder by the carburetor of the engine. An electronic control circuit operates to judge whether the output of the $O_2$-sensor is higher or lower than a standard value corresponding to the stoichiometric air-fuel ratio and produces an output signal. The output signal is converted to a driving pulse train through a pulse generator and driving circuit, which is fed to an actuator for the carburetor. Thus, the air-fuel ratio of the mixture is controlled to the stoichiometric air-fuel ratio.

In the case that the $O_2$-sensor fails to detect the oxygen content or the feedback control circuit malfunctions, the air-fuel ratio of the mixture diverges to the rich or lean side from the stoichiometry value. To avoid such erroneous air-fuel ratios, a conventional control circuit is so arranged that when the extremely rich or lean air-fuel ratio continues for a predetermined period, feedback operation of the circuit is cut out and a constant output signal a providing medium air-fuel ratio is produced.

However, such a control operation is also carried out in the case of a rich or lean air-fuel ratio caused by a malfunction of the carburetor or during a driving of a car at a high altitude. If the control circuit generates the signal for the medium air-fuel ratio in such a condition, the actual air-fuel ratio of the mixture diverges to an extremely rich or lean value, which results in malfunctioning or stopping of the engine.

SUMMARY OF THE INVENTION

The object of the present invention is to reduce the above described drawbacks of the conventional control system.

According to the present invention, there is provided an air-fuel ratio control system for an internal combustion engine having an intake passage, an exhaust passage, detector means for detecting the concentration of a constituent of the exhaust gases passing through the exhaust passage, an electromagnetic valve for correcting the air-fuel ratio of the air-fuel mixture supplied by an air-fuel mixture supply means, a feedback control means comprising a judging circuit means for judging an output signal of the detector means and a driving circuit for producing a driving output for driving the electromagnetic valve in dependency on an output signal of the judging circuit means for controlling the air-fuel ratio to a value approximately to the stoichiometric air-fuel ratio. The invention provides maximum value hold circuit means for holding a maximum value in one cycle of output variation of the detector means, a minimum value hold circuit means for holding a minimum value in one cycle of output variation of the detector means, a first comparator means for comparing outputs of both hold circuits and for producing an output signal, a second comparator means for comparing the output of the detector means with a predetermined level and for producing an output signal to the gate circuit responsive to the output signals of the comparators for producing gate control signals, switch circuits responsive to the gate control signals, and a fixed voltage supply source, the gate circuit and the switch circuits being such that when the output of the second comparator means is high representing an output of the $O_2$-sensor higher than the predetermined level or when the output of the second comparator means is low and the output of said first comparator means is high, the switch circuits operate to connect the output of the detector means to the judging circuit means for performing the feedback control, but when the outputs of both comparator means are low, the switch circuits connect the fixed voltage supply source to the judging circuit means.

With the above and other objects and advantages in view, the present invention will become more clearly understood in connection with the detailed description of a preferred embodiment, when considered with the accompanying drawings, of which:

DETAILED DESCRIPTION OF THE PREFERRED EMBODIMENTS

Figure 1:
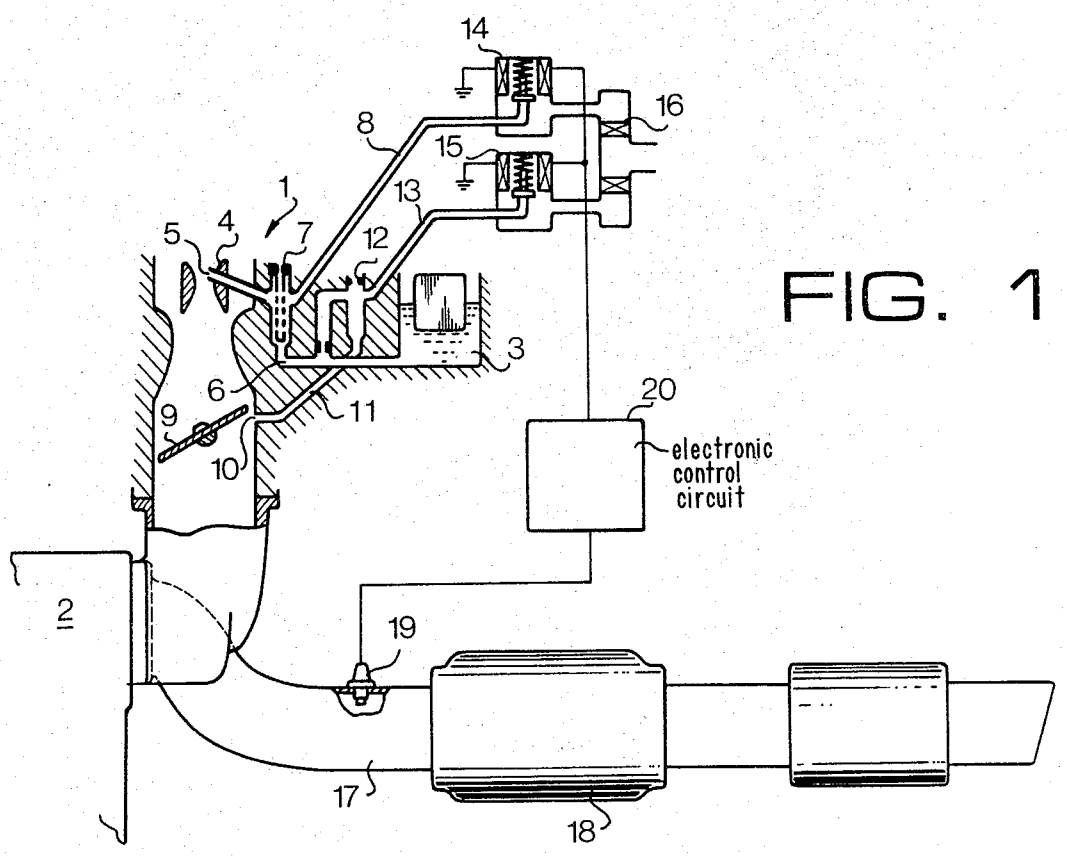
FIG. 1 is a schematic illustration showing an air-fuel ratio control system.

Referring to FIG. 1, a carburetor 1 communicates with an internal combustion engine 2. The carburetor comprises a float chamber 3, a venturi 4, a nozzle 5 communicating with the float chamber 3 through a main fuel passage 6, and a slow port 10 which is opened near a throttle valve 9 and communicates with the float chamber 3 through a slow fuel passage 11. Air correcting passages 8 and 13 are provided parallel to a main air bleed 7 and a slow air bleed 12, respectively. On-off type electromagnetic valves 14 and 15 are provided for the air correcting passages 8 and 13. An inlet port of each on-off electromagnetic valve communicates with atmosphere through an air cleaner 16. An $O_2$-sensor 19 is provided on an exhaust pipe 17 from the engine upstream of a three-way catalytic converter 18, for detecting the oxygen content of exhaust gases. The $O_2$-sensor 19 is connected to an electronic control circuit 20 for actuating on-off electromagnetic valves 14 and 15 to control the air-fuel ratio of the mixture to a value approximately equal to the stoichiometric air-fuel ratio.

Figure 2:
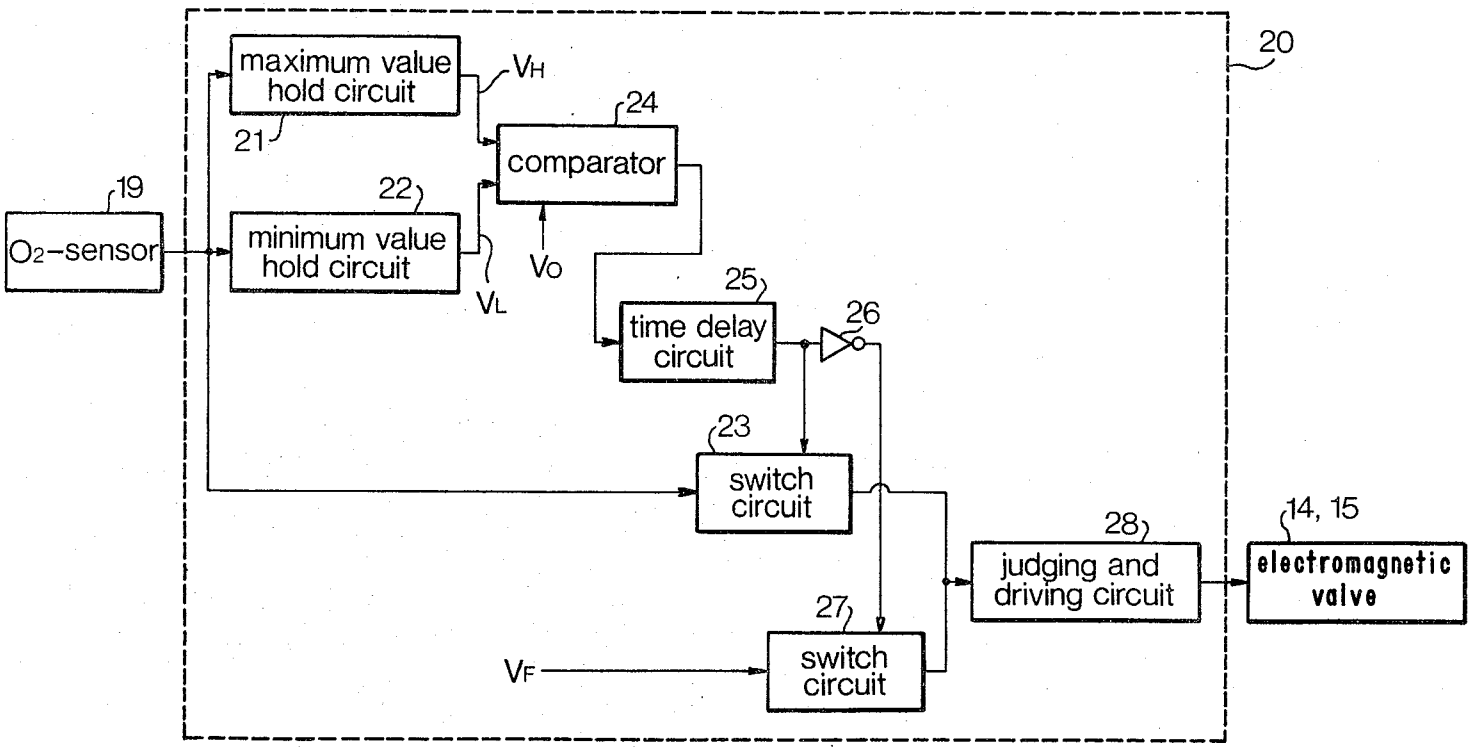
FIG. 2 is a block diagram of a conventional control circuit.

Referring to FIG. 2 showing a conventional control circuit 20, the output of the $O_2$-sensor 19 is connected to a maximum value hold circuit 21, to a minimum value hold circuit 22 and to a switch circuit 23. Outputs of the maximum value hold circuit 21 and the minimum value hold circuit 22 are connected to a comparator 24, the output of which is connected to an inverter 26 and to a gate of the switch circuit 23 through a time delay circuit 25. The output of the inverter 26 is connected to a gate of a switch circuit 27. Outputs of switch circuits 23 and 27 are fed to a judging and driving circuit 28 including an integrating circuit for producing a control output which is fed to the on-off electromagnetic valves 14 and 15 for controlling the air-fuel ratio.

Figure 3:
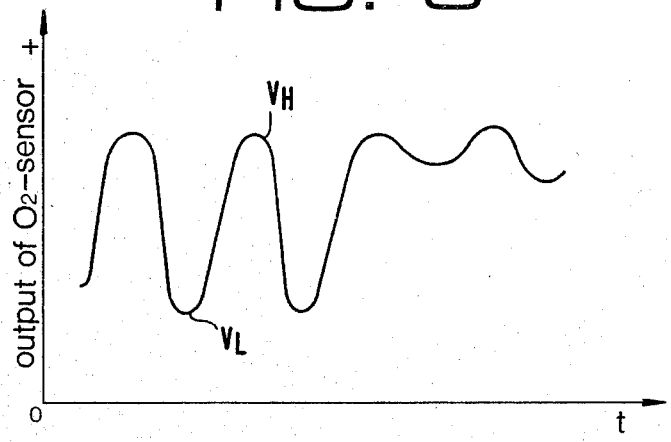
FIG. 3 is a graph showing an output waveform of an $O_2$-sensor.
Figure 5:
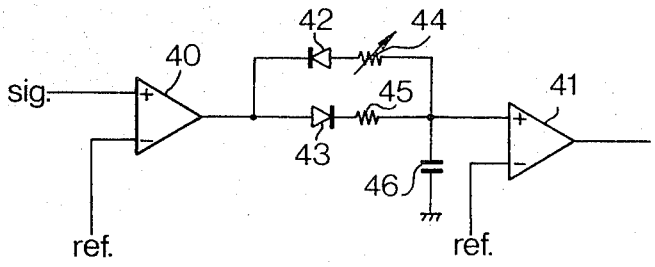
FIG. 5 shows a time delay circuit.

FIG. 3 shows an example of the output waveform of the $O_2$-sensor 19. The $O_2$-sensor produces a high level output upon detecting rich exhaust gases and a low level output upon detecting lean exhaust gases. The maximum value VH and the minimum value VL in one cycle of the output variation are memorized in the maximum value hold circuit 21 and the minimum value hold circuit 22 respectively. The comparator 24 compares the difference between the outputs of circuits 21 and 22 (VH-VL) with a predetermined standard level Vo. When the difference is higher than the standard level Vo, a high level signal is fed to the time delay circuit 25, and when the difference is lower, a low level signal is fed to the time delay circuit 25. The time delay circuit 25 comprises operational amplifiers 40, 41, diodes 42, 43, resistors 44, 45 and a capacitor 46 as shown in FIG. 5. The time delay circuit 25 produces a high level signal immediately after receiving the high level input, so that the switch circuit 23 is operated to close the circuit for actuating the judging and driving circuit 28. However, when the low level input is received, the time delay circuit 25 continues to generate the high level signal for a predetermined period of time, after which it generates a low level signal. Consequently, when lean exhaust gases are detected by the $O_2$-sensor 19, the switch circuit 23 is cut off after the predetermined period of time and the switch circuit 27 is closed. Thus, a predetermined fixed voltage VF is applied to the judging and driving circuit 28, so that the on-off type electromagnetic valves 14 and 15 are actuated at a predetermined duty ratio.

Figure 4:
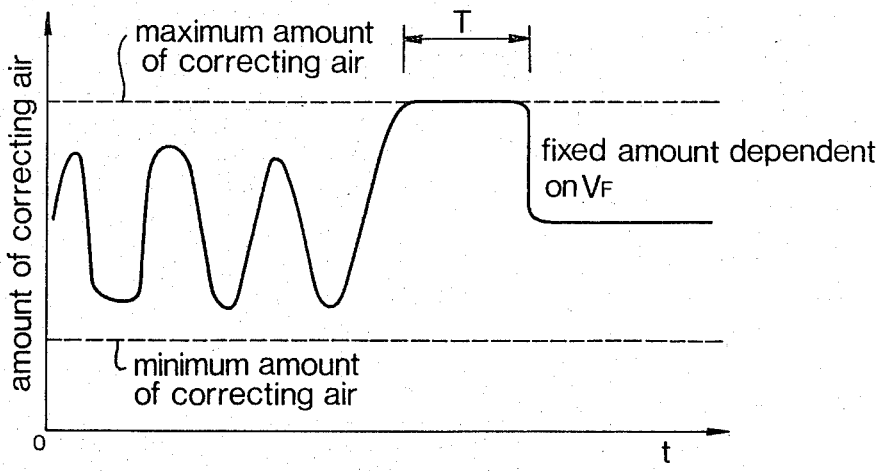
FIG. 4 is a graph showing amount of correcting air with respect to time by the conventional control circuit.

FIG. 4 shows the amount of the correcting air. The amount of correcting air decreases from the maximum amount to the fixed amount dependent on the voltage VF with a time delay T.

If the decrease of the correcting air is effected under the condition that a rich air-fuel ratio mixture is supplied by a malfunction of the carburetor, an extremely rich air-fuel ratio of the mixture is supplied to the engine, which will result in stopping the engine.

The present invention provides a system which can remove such disadvantages.

Figure 6:
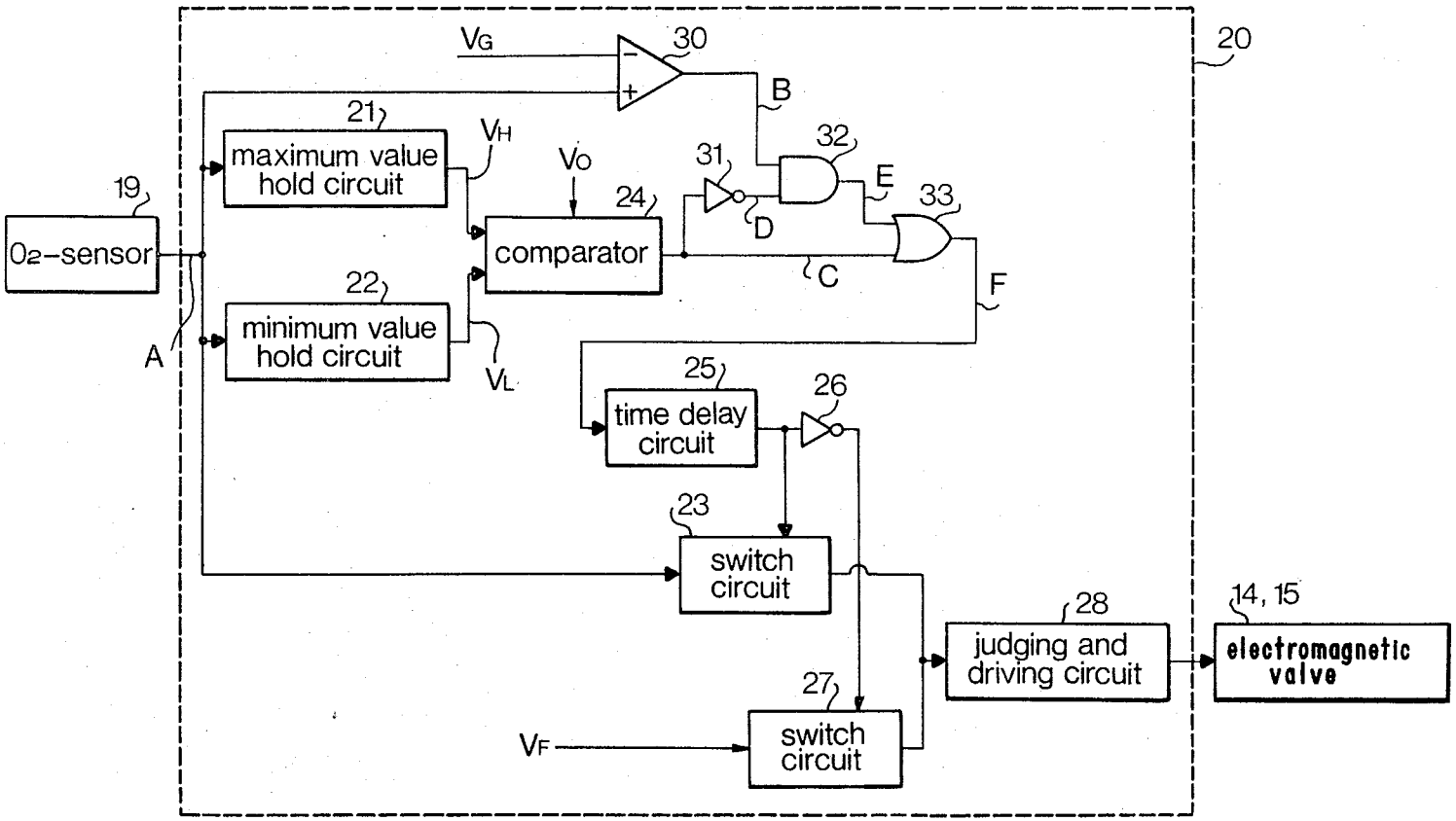
FIG. 6 is a block diagram showing an embodiment of the present invention.

Referring to FIG. 6, in accordance with the present invention the output A of the $O_2$-sensor 19 is applied to the maximum value hold circuit 21, the minimum value hold circuit 22 and the switch 23 and also to a comparator 30 which is fed with an input reference value VG. The output C of the comparator 24 is sent to an inverter 31 and an OR gate 33. Outputs B and D of the comparator 30 and the inverter 31 respectively are connected to inputs of an AND gate 32. The output E of the AND gate 32 is connected to the other input of the OR gate 33, the output F of which is in turn fed to the time delay circuit 25.

When the output A of the $O_2$-sensor 19 is higher than the reference level VG of the comparator 30, a high level signal is applied to the AND gate 32. When $(VH-VL) \geqq Vo$, the output of the comparator 24, which is applied to the OR gate 33 is at a high level. Accordingly, the output of the OR gate 33 is at a high level regardless of the output E of the AND gate 32. The high level output F is applied to the switch circuit 23 through the time delay circuit 25 to close the switch circuit 23. Thus, the feedback control operation is carried out in dependency on the output A of the $O_2$-sensor 19.

Figures 7, 8:
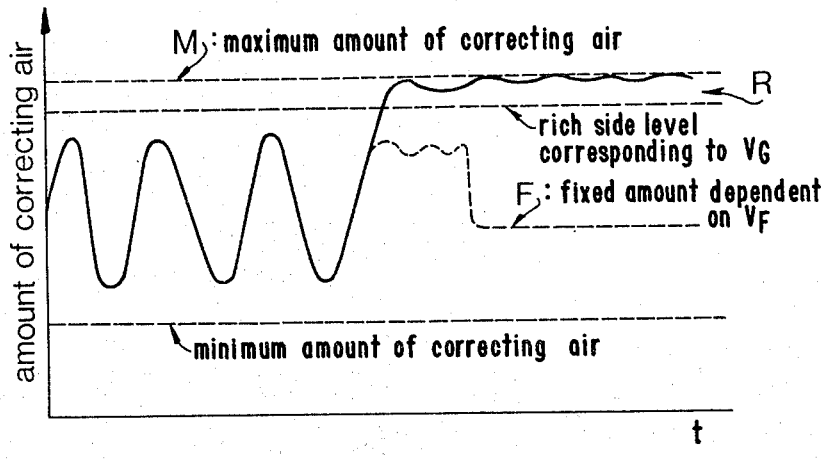
FIG. 7 is a graph showing amount of correcting air with respect to time by the control circuit of the present invention.
FIG. 8 is a truth table of the control circuit of the present invention.

When $(VH-VL) < Vo$ and $V > VG$, the output B of the comparator 30 is at a high level and the output D of the inverter 31 is at a high level, so that the output E of the AND gate goes to a high level. Therefore, the output F of the OR gate 33 is kept at the high level, although the level of the output C of the comparator 24 is low. Thus, the feedback control is maintained and the amount of the correcting air varies in a rich zone R with a small amplitude near the maximum line M as shown in FIG. 7.

When $A < VG$ the output B of the comparator 30 goes to a low level. Thus, the output E of the AND gate 32 goes to a low level irrespective of the level of the signal D. Accordingly, when $(VH-VL) \geqq Vo$, a high level signal is applied to the switch circuit 23 through the time delay circuit 25 for providing the feedback control operation. When $(VH-VL) < Vo$, a low level signal is applied to the switch circuit 23 to cut off it and to turn on the switch circuit 27. Thus, a fixed voltage VF is applied to the judging circuit 28 so that a fixed amount F of air is provided as shown in FIG. 7.

It will be noted that the control system may be constructed so as also to control an extremely lean air-fuel ratio mixture.

What is claimed is:

1. In an air-fuel ratio control system for an internal combustion engine having an intake passage and an exhaust passage, detector means for detecting the concentration of a constituent of exhaust gases passing through said exhaust passage and producing an output signal having cycles of output variation, an electromagnetic valve for correcting the air-fuel ratio of the air-fuel mixture supplied to the intake passage by an air-fuel mixture supply means, a feedback control means comprising a judging circuit means for judging the output signal of said detector means and a driving circuit for producing a driving output for driving said electromagnetic valve in dependency on an output signal of said judging circuit means for controlling the air-fuel ratio by feedback control to a value approximately to a stoichiometric air-fuel ratio, the improvement comprising a maximum value hold circuit means for holding a maximum value of the output signal of said detector means in one cycle of the output variation of the detector means, a minimum value hold circuit means for holding a minimum value of the output signal of said detector means in said one cycle of output variation of said detector means, a first comparator means for comparing outputs of said both hold circuit means and for producing an output signal which is low when the difference of said maximum value from said minimum value is lower than a predetermined value, a second comparator means for comparing the output signal of said detector means with a predetermined reference level and for producing an output signal gate circuit means responsive to said output signals of said first and second comparator means for producing gate control signals, a fixed voltage supply source, switch circuits responsive to said gate control signals and connected to said detector means and said fixed voltage supply source, respectively, and to said judging circuit means, said gate circuit means for operating said switch circuits such that when the output signal of said detector means is at least as high as said predetermined reference level regardless of the level of the output signal of said first comparator means, or, the output of said detector means is lower than said predetermined reference level and the output of said first comparator means is high, said switch circuits connect the output signal of said detector means to said judging circuit means for performing the feedback control, but when the output signal of said first comparator means is low and the output of said detector means is lower than said predetermined reference level, said switch circuits connect said fixed voltage supply source to said judging circuit means.

2. In a feedback air-fuel ratio control system for an engine having a detector means for detecting a constituent of exhaust gases from the engine connected to a feedback control circuit for controlling the air-fuel ratio of an air-fuel mixture supplied to the engine via an on-off electromagnetic valve producing oscillation cycles in a detected output of the detector means, the improvement comprising first means for producing a first signal when the difference between a maximum and minimum value of said detected output in one cycle of said oscillation cycles is lower than a first predetermined value, comparator means for producing a second signal when the detected output is lower than a predetermined reference value, the latter being lower than a maximum value of the detected output of the detector means, means for disconnecting said detector means from and for connecting a fixed signal to said control circuit only when said first and second signals occur simultaneously for a predetermined time and for connecting said detector means to and disconnecting said fixed signal from said control circuit upon the non-occurrence of at least one of said first and second signals.

3. In a feedback air-fuel ratio control system for an engine having a detector means for detecting a constituent of exhaust gases from the engine connected to a control circuit for controlling the air-fuel ratio of an air-fuel mixture supplied to the engine via an on-off electromagnetic valve producing oscillation cycles in the detected output of the detector means, the improvement comprising first means for producing a first signal when the difference between a maximum and minimum value of said detected output in one cycle of the oscillation cycles is lower than a first predetermined value, comparator means for producing a second signal when said detected output is higher than a predetermined reference value, the latter being higher than a minimum value of said detected output of said detector means, means for disconnecting said detector means from and for connecting a fixed signal to said control circuit only when said first and second signals occur simultaneously for a predetermined time and for connecting said detector means to and disconnecting said fixed signal from said control circuit upon the non-occurrence of at least one of said first and second signals.

4. The air-fuel ratio control system as set forth in claim 1, wherein said gate circuit means comprises, an OR gate having an output operatively connected to one of said switch circuits and having one input connected to the output of said first comparator means, an AND gate having one input connected to the output of said second comparator means an output connected to another input of said OR gate, a first inverter connected between the output of said first comparator means and another input of said AND gate, and a second inverter operatively connects the output of said OR gate to the other of said switch circuits.

5. The air-fuel ratio control system as set forth in claim 4, further comprising a time delay means is operatively connected between said switch circuits and the output of said OR gate for delaying transmitting a low level output of said OR gate to said switch circuits for a predetermined time.

* * * * *